US008726649B2

(12) United States Patent
Nanjo et al.

(10) Patent No.: US 8,726,649 B2
(45) Date of Patent: May 20, 2014

(54) CONTROLLER AND WORK MACHINE PROVIDED THEREWITH

(75) Inventors: Takao Nanjo, Kobe (JP); Saburo Senoo, Hiroshima (JP); Mitsunori Hirozawa, Hiroshima (JP)

(73) Assignees: Kabushiki Kaisha (Kobe Steel, Ltd.), Kobe-shi (JP); Kobelco Construction Machinery Co., Ltd., Hiroshima-shi (JP)

( * ) Notice: Subject to any disclaimer, the term of this patent is extended or adjusted under 35 U.S.C. 154(b) by 1020 days.

(21) Appl. No.: 12/787,706

(22) Filed: May 26, 2010

(65) Prior Publication Data

US 2010/0303642 A1 Dec. 2, 2010

(30) Foreign Application Priority Data

May 29, 2009 (JP) ..... 2009-130071

(51) Int. Cl.
*F04B 49/00* (2006.01)

(52) U.S. Cl.
USPC ..... 60/450; 60/445

(58) Field of Classification Search
USPC ..... 60/445, 450
See application file for complete search history.

(56) References Cited

U.S. PATENT DOCUMENTS 5,077,973 A 1/1992 Suzuki et al.
5,421,155 A * 6/1995 Hirata et al. ..... 60/452
5,575,148 A * 11/1996 Hirata et al. ..... 60/445
2002/0073699 A1 6/2002 Nishimura et al.
2004/0060205 A1 4/2004 Yoshino

FOREIGN PATENT DOCUMENTS

| | | | |
|---|---|---|---|
| CN | 1347818 | A | 5/2002 |
| JP | 9-49248 | A | 2/1997 |
| JP | 2001-248186 | | 9/2001 |
| JP | 2002-138965 | | 5/2002 |
| JP | 2003-65301 | A | 3/2003 |
| JP | 3886480 | B2 | 2/2007 |
| WO | WO 90/01587 | A1 | 2/1990 |

OTHER PUBLICATIONS

Combined Chinese Office Action and Search Report Issued Oct. 31, 2012 in Patent Application No. 201010193615.2 (with English Summary and English translation of Categories of Cited Documents).

* cited by examiner

*Primary Examiner* — F. Daniel Lopez
(74) *Attorney, Agent, or Firm* — Oblon, Spivak, McClelland, Maier & Neustadt, L.L.P.

(57) ABSTRACT

A controller includes a storage unit that stores a map in which an operation amount and an upper limit value of suction torque of a hydraulic pump are associated with each other, for each operation content identified by a cylinder that is an operation object out of the cylinders, and by a direction of operation performed on this cylinder; an operation torque determination unit that determines the upper limit value of suction torque for each cylinder by using the map stored in the storage unit when an actuation command relating to at least one cylinder is input by an operation lever; a high-level selection unit that selects the maximum upper limit value of suction torque out of the upper limit values of suction torque determined by the operation torque determination unit; and a regulator that regulates a displacement of the hydraulic pump so as to obtain torque equal to or lower than the suction torque selected by the high-level selection unit.

6 Claims, 6 Drawing Sheets

CONTROLLER AND WORK MACHINE PROVIDED THEREWITH

BACKGROUND OF THE INVENTION

1. Field of the Invention

The present invention relates to a controller that performs torque control of a hydraulic pump for supplying hydraulic oil to a plurality of actuators and also relates to a work machine provided with the controller.

2. Description of the Background Art

Work machines have been known that include a variable displacement hydraulic pump driven by an engine and a plurality of actuators that are actuated by hydraulic oil supplied from the hydraulic pump.

In a work machine of this kind, the suction torque (torque) of the hydraulic pump is set based on an accelerator command or mode selection command input by the operator, and the tilt angle of the hydraulic pump is controlled so that the output of the hydraulic pump (sum total of outputs of hydraulic pumps when a plurality of hydraulic pumps are provided) does not exceed the suction torque.

However, where the suction torque is fixed to a constant value, the hydraulic pump output can, under certain operation conditions (a large load or combination of actuator operations), be set to be equal to or higher than the output that is actually necessary to actuate the actuators and the operation efficiency can decrease.

In order to resolve this problem, for example, Japanese Patent Application Laid-Open Nos. 2001-248186 and 2002-138965 disclose a configuration in which a discharge pressure of a hydraulic pump is detected and the suction torque of the hydraulic pump is regulated correspondingly to the value of the discharge pressure.

However, in order to control the speed of each actuator, throttles of M/I (meter-in) opening or M/O (meter-out) opening are provided in a hydraulic circuit, and the discharge pressure of the hydraulic pump that is demonstrated as a result of the throttling does not accurately correspond to the load necessary to actuate the actuators. The resultant problem is that when the suction torque of the hydraulic pump is set based on the discharge pressure of the hydraulic pump as in the configuration disclosed in Japanese Patent Application Laid-Open Nos. 2001-248186 and 2002-138965, a suction torque is set that exceeds the torque that is actually necessary for the actuators.

More specifically, for example, in a boom cylinder serving to raise and lower the boom of the work machine, although the discharge pressure of the hydraulic pump increases due to pressure loss in response to throttling in both the boom raising operation and the boom lowering operation, the suction torque that is actually necessary is large in the raising operation and small in the lowering operation. With the configuration disclosed in Japanese Patent Application Laid-Open Nos. 2001-248186 and 2002-138965, since the suction torque of the hydraulic pump is set correspondingly to the discharge pressure of the hydraulic pump, irrespectively of the operation contents, the suction torque of the hydraulic pump is also set higher than the output necessary to actuate the actuators.

SUMMARY OF THE INVENTION

The present invention was created to resolve the above-described problems and it is an object of the present invention to provide a controller that can prevent the setting of suction torque that exceeds the torque actually necessary for each actuator, and to provide also a work machine provided with such a controller.

In order to resolve the above-described problems, the present invention provides a controller for a work machine including a variable displacement hydraulic pump driven by an engine, a plurality of actuators to which hydraulic oil is supplied from the hydraulic pump, an input unit that receives an operation for inputting an actuation command relating to each of the actuators, a storage unit that stores torque information in which an operation amount and an upper limit value of suction torque of the hydraulic pump are associated with each other, for each operation content identified by an actuator that is selected to be operated from the actuators, and by a direction of the operation performed on this actuator, an operation torque determination unit that determines the upper limit value of suction torque for each actuator by using the torque information stored in the storage unit, when an actuation command relating to at least one actuator is input by the input unit, a high-level selection unit that selects the maximum upper limit value of suction torque out of the upper limit values of suction torque determined by the operation torque determination unit, and a displacement regulation unit that regulates a displacement of the hydraulic pump so as to obtain torque equal to or lower than the suction torque selected by the high-level selection unit, wherein the torque information relating to at least one operation content, out of the torque information stored in the storage unit, has a characteristic such that the upper limit value of suction torque varies in accordance with variations in operation amount of the input unit.

Further, the present invention provides a work machine including an engine, and the controller, wherein the input unit of the controller receives an operation for inputting an actuation command relating to each of the actuators, the operation torque determination unit determines an upper limit value of suction torque of the hydraulic pump for each of the actuators, and the displacement regulation unit regulates a displacement of the hydraulic pump so as to obtain torque equal to or lower than the maximum upper limit value of suction torque out of the upper limit values of suction torque.

In accordance with the present invention, the setting of suction torque that exceeds the torque actually necessary for each actuator can be prevented.

DETAILED DESCRIPTION OF THE PREFERRED EMBODIMENTS OF THE INVENTION

The preferred embodiments of the present invention will be described below with reference to the appended drawings.

Figure 1:
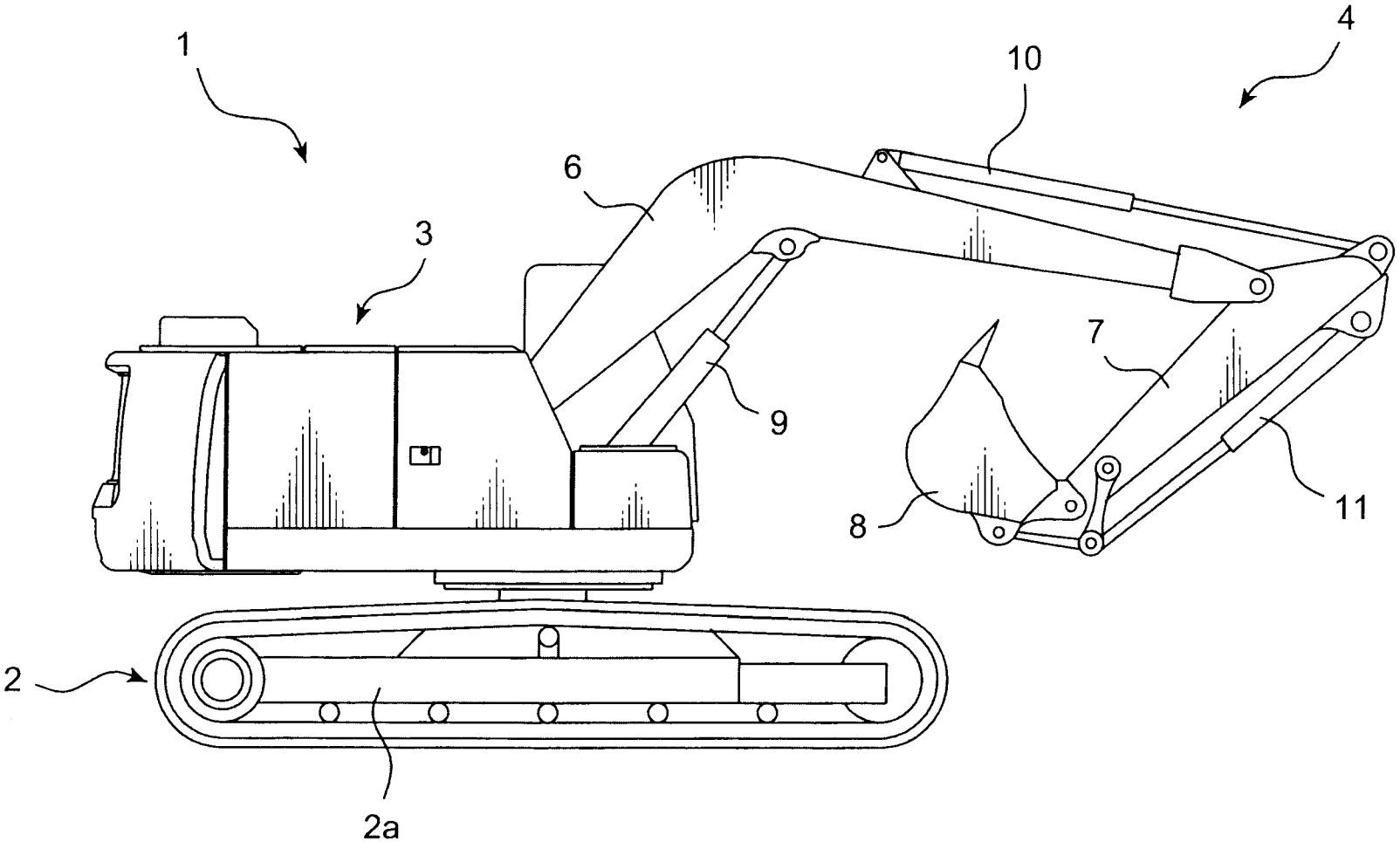
FIG. 1 is a side view illustrating a hydraulic shovel according to an embodiment of the present invention.

FIG. 1 is a side view illustrating a hydraulic shovel according to an embodiment of the present invention.

Referring to FIG. 1, a hydraulic shovel 1 serving as an example of a work machine includes a undercarriage 2 having a crawler 2*a*, an upper structure 3 provided rotatably on the undercarriage 2, a work attachment 4 that is supported by the upper structure 3 so that the work attachment can be raised and lowered, and a controller 5 (see FIG. 2), provided at the upper structure 3.

The work attachment 4 is provided with a boom 6, an arm 7 linked to a distal end portion of the boom 6, and a bucket 8 that is swingably attached to the distal end portion of the arm 7. The boom 6 is raised and lowered with respect to the upper structure 3 by a telescopic operation of a boom cylinder 9. The arm 7 is swung with respect to the boom 6 by the telescopic operation of an arm cylinder 10. The bucket 8 is swung with respect to the arm 7 by the telescopic operation of a bucket cylinder 11.

A rotation motor (not shown in the figure) is provided at the undercarriage 2, and the upper structure 3 is rotated about a vertical axis with respect to the undercarriage 2 in response to the rotation drive of the rotation motor.

In the present embodiment, the cylinders 9 to 11 and rotation motor (not shown in the figure) serve as examples of actuators. In the explanation below, only the boom cylinder 9 and bucket cylinder 11 are shown in the figures and explained as representative actuators.

Figure 2:
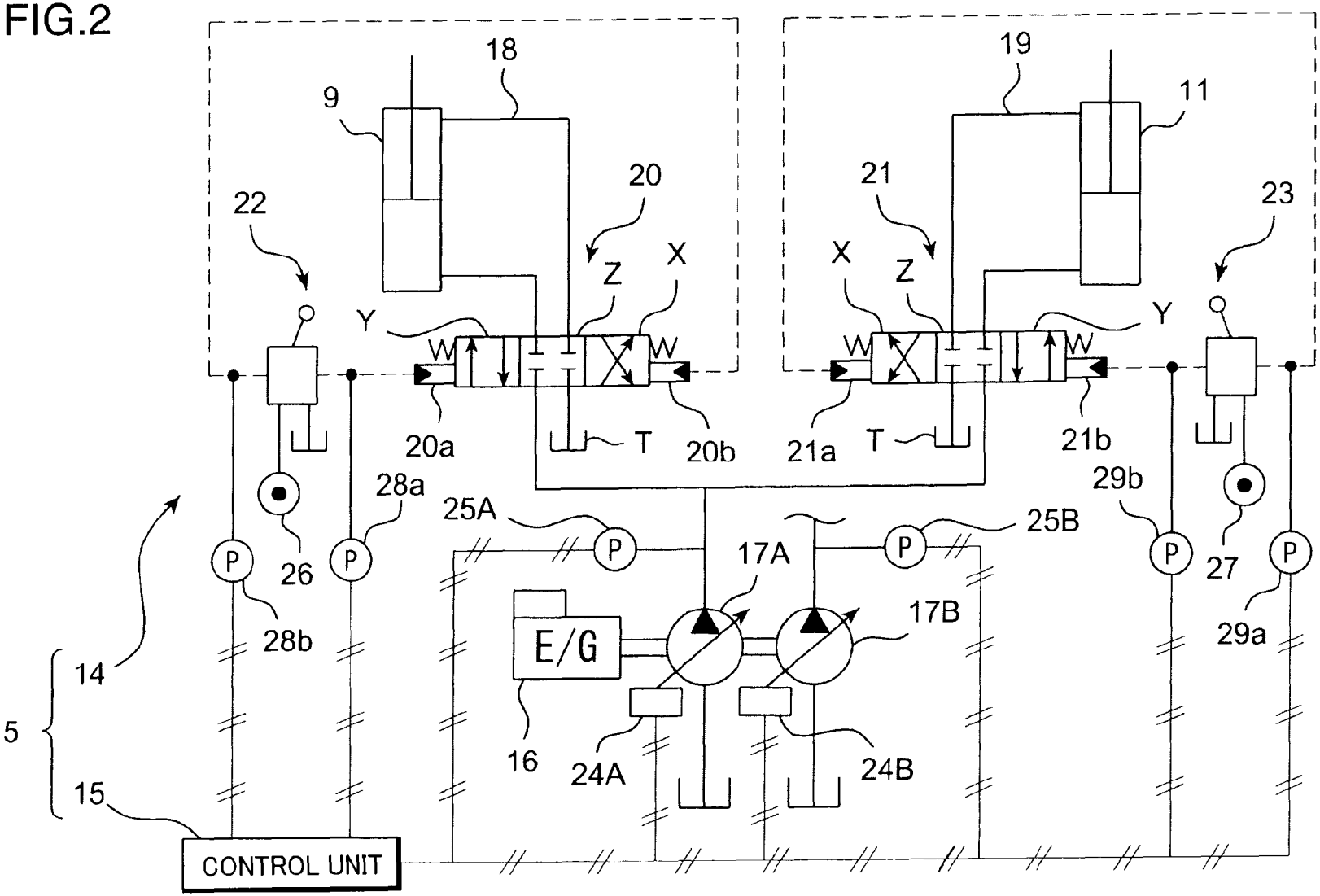
FIG. 2 is a circuit diagram illustrating the electric configuration and hydraulic configuration of the controller provided in the hydraulic shovel shown in FIG. 1.

FIG. 2 is a circuit diagram illustrating the electric configuration and hydraulic configuration of the controller 5 provided in the hydraulic shovel 1 shown in FIG. 1.

Referring to FIG. 2, the controller 5 is provided with a hydraulic circuit 14 including the cylinders 9 to 11 and the rotation motor and a control unit 15 that electrically controls the flow of hydraulic oil in the hydraulic circuit 14. The controller 5 appropriately regulates the suction torque of the below-described hydraulic pumps 17A, 17B provided in the hydraulic circuit 14 by adjusting the tilt angle of the hydraulic pumps 17A, 17B. The control of suction torque of the hydraulic pump 17A that supplies the hydraulic oil to the cylinders 9, 11 will be explained below, but the hydraulic pump 17B can be controlled in a similar manner.

More specifically, the hydraulic circuit 14 includes a pair of hydraulic pumps 17A, 17B driven by an engine 16, supply-discharge paths 18, 19 that supply the hydraulic oil discharged from the hydraulic pump 17A to the cylinders 9, 11 and guide the hydraulic oil released from the cylinders 9, 11 into a tank T, control valves 20, 21 provided in midstream of these supply-discharge paths 18, 19, and operation levers (input units) 22, 23 for supplying a pilot pressure to the control valves 20, 21.

The hydraulic pumps 17A, 17B are variable displacement pumps provided with regulators 24A, 24B for tilt angle regulation. These regulators 24A, 24B are electrically connected to the below-described control unit 15. The hydraulic pump 17B supplies hydraulic oil to other hydraulic actuators (arm cylinder 10, rotation motor, and the like); this process is not illustrated by the figures. Pump pressure sensors 25A, 25B that can detect the discharge pressure of the hydraulic oil created by the hydraulic pumps 17A, 17B are provided in hydraulic paths connected to the hydraulic pumps 17A, 17B. These pump pressure sensors 25A, 25B are electrically connected to the control unit 15.

The supply-discharge paths 18, 19 respectively connect the hydraulic pump 17A and tank T to the rod side chamber or head side chamber of the cylinders 9, 11 in response to a switching operation of the control valves 20, 21.

More specifically, the control valves 20, 21 are configured to be switchable between a switching position X in which the rod side chambers of the cylinders 9, 11 are linked to the hydraulic pump 17A, a switching position Y in which the head side chambers of the cylinders 9, 11 are linked to the hydraulic pump 17A, and a neutral position Z in which the cylinders 9, 11 are cut off from the hydraulic pump 17A and the tank T. Further, the control valves 20, 21 are held in the neutral state Z when no pilot pressure is applied thereto.

The operation lever 22 can supply the hydraulic oil discharged from the pilot pump 26 to the pilot port 20*a* or pilot port 20*b* of the control valves 20. Further, the operation lever 23 also can supply the hydraulic oil discharged from the pilot pump 27 to the pilot port 21*a* or pilot port 21*b* of the control valves 21.

Four operation pressure sensors 28*a*, 28*b*, 29*a*, 29*b* (can be also referred to hereinbelow as operation pressure sensors 28*a* to 29*b*) are provided in pilot lines connecting the operation levers 22, 23 to the control valves 20, 21. The operation pressure sensor 28*a* can detect the pilot pressure applied to the pilot port 20*a* of the control valve 20. The operation pressure sensor 28*b* can detect the pilot pressure applied to the pilot port 20*b* of the control valve 20. The operation pressure sensor 29*a* can detect the pilot pressure applied to the pilot port 21*a* of the control valve 21. The operation pressure sensor 29*b* can detect the pilot pressure applied to the pilot port 21*b* of the control valve 21.

A specific configuration of the control unit 15 will be described below with reference to FIG. 3.

Figure 3:
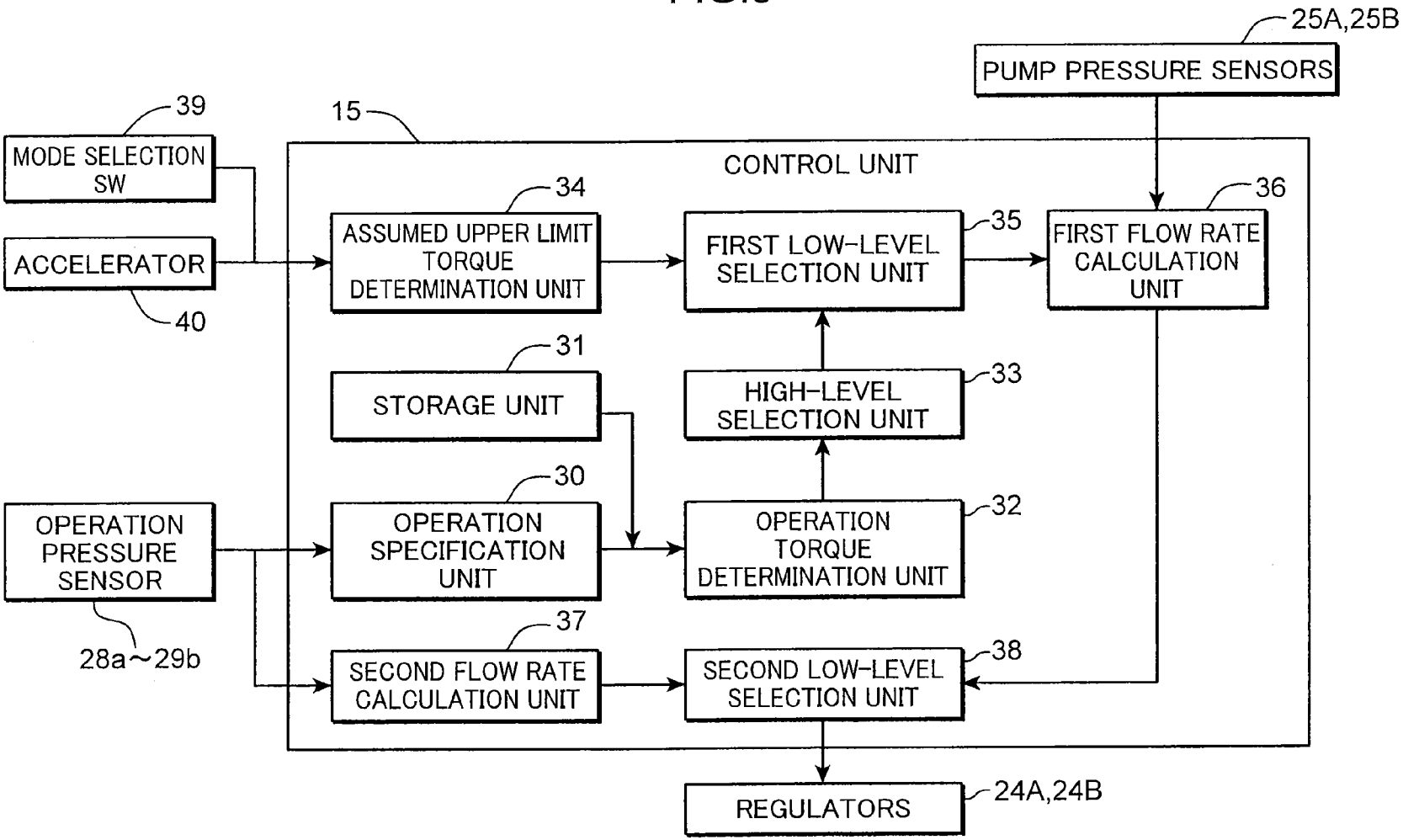
FIG. 3 is a block diagram illustrating the electric configuration of the controller.

Referring to FIG. 3, the control unit 15 is provided with an operation specification unit 30 that specifies an operation amount and an operation direction of the operation levers 22, 23, a storage unit 31 that stores a map (torque information: see FIG. 4) of suction torque of the hydraulic pumps 17A, 17B, an operation torque determination unit 32 that reads the suction torque from the storage unit 31, a high-level selection unit 33 that selects the maximum suction torque out of the suction torque determined by the operation torque determination unit 32, an assumed upper limit torque determination unit 34 that determines the below-described assumed upper limit torque, a first low-level selection unit 35 that selects the lower of the suction torque selected by the high-level selection unit 33 and the assumed upper limit torque, a first flow rate calculation unit 36 for calculating the first flow rate, a second flow rate calculation unit 37 for calculating the second flow rate, and a second low-level selection unit 38 that selects the smaller of the first flow rate and the second flow rate.

When an operation of at least one operation lever is detected by the operation pressure sensors 28*a* to 29*b*, the operation specification unit 30 specifies the operation amount and operation direction of operation levers 22, 23 on the basis of detection signals from the operation pressure sensors 28*a* to 29*b*. As a result, the operation contents (for example, boom rise operation, boom lowering operation, bucket discharge operation, bucket digging operation) identified by the cylinders 9, 11 and the direction of operations performed on these cylinders 9, 11 and the operation amount (including a state without any operation) of the operation levers 22, 23 are specified.

Figure 4:
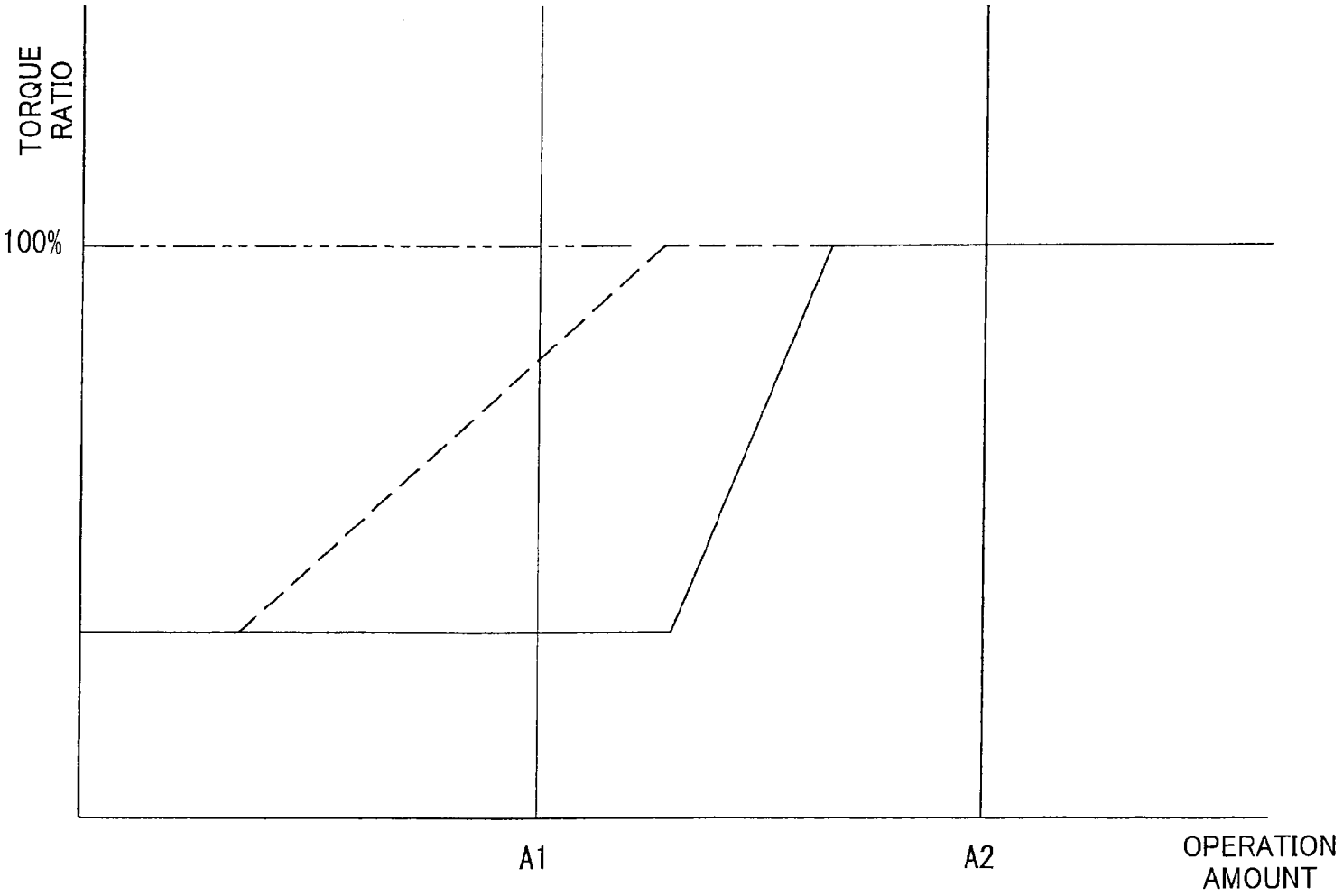
FIG. 4 shows an example of map stored in the storage unit.

The storage unit 31 stores a map of upper limit values of suction torque such as shown in FIG. 4. More specifically, in the map, the operation amount of the operation levers 22, 23 is plotted against the abscissa and a ratio to the below-described assumed upper limit torque is plotted against the ordinate. In FIG. 4, settings for a bucket digging operation are shown by way of example by a broken line and settings for a boom lowering operation are shown by a solid line. In the present embodiment, the above-described map is stored in the storage unit 31 for all of the operations performed by all of the actuators. As follows from FIG. 4, in a bucket digging operation with a comparatively high load, the setting is at the upper limit value of suction torque (torque ratio) even in a range with a small operation amount of the operation lever 23. By contrast, in the boom lowering operation with a small load in which the weight of the boom itself acts in the operation direction, the upper limit value of suction torque (torque ratio) is a small and constant value in a range with a small operation amount. In the example shown in FIG. 4, the upper limit value of suction torque is set to a value equal to the assumed upper limit torque (torque ratio is 100%) both for the boom lowering operation and the bucket digging operation, but it can be also set to a value exceeding the assumed upper limit torque.

In the map shown in FIG. 4, in a range below a constant amount from a state in which the operation levers 22, 23 are not operated, the upper limit value of suction torque is constant, regardless of the operation amount of the operation levers 22, 23. Therefore, even when the operation levers 22, 23 are erroneously slightly operated, for example, when the operator touches the operation levers 22, 23 unintentionally, the occurrence of an undesirable event in which the suction torque of the hydraulic pump 17A changes abruptly can be avoided. Further, with respect to a predetermined range in the map that exceeds the aforementioned range below a constant amount, the upper limit value of suction torque is set to increase or decrease correspondingly to the operation amount of the operation levers 22, 23 (a proportional relationship between the operation amount and the torque ratio). Therefore, the abrupt increase or decrease in the suction torque can be inhibited by comparison with the case in which the upper limit value of suction torque is changed to a maximum or to a minimum corresponding to the operation state or a non-operative state of the operation levers 22, 23. This also allows the feeling of discomfort of the operator to be alleviated.

Referring to FIG. 3 again, the operation torque determination unit 32 determines an upper limit value of the suction torque of the hydraulic pump 17A for each cylinder 9, 11 (each of all of the actuators that receive the hydraulic oil supplied from the hydraulic pump 17A) on the basis of the operation contents identified by the operation specification unit 30 and the map stored in the storage unit 31. More specifically, the operation torque determination unit 32 reads the upper limit value of suction torque corresponding to the operation amount of the operation lever 22, 23 on the map from the storage unit 31.

The high-level selection unit 33 selects the highest value out of the upper limit values of the suction torque relating the cylinders 9, 11 (including other actuators that receive the hydraulic oil supplied from the hydraulic pump 17A) determined by the operation torque determination unit 32.

The assumed upper limit torque determination unit 34 determines the assumed upper limit torque as an upper limit value of suction torque of the hydraulic pump 17A for which the output of the engine 16 does not exceed a predetermined value. More specifically, the assumed upper limit torque is appropriately set such that no malfunction such as engine stall occurs in response to an engine load that is changed when the operator operates an accelerator 40 or a mode selection switch 39 for switching the operation mode, e.g., traveling mode and work mode.

The first low-level selection unit 35 selects the smaller of the assumed upper limit torque and the upper limit value of suction torque that has been selected by the high-level selection unit 33.

The first flow rate calculation unit 36 calculates the first flow rate, which is a flow rate that has to be discharged by the hydraulic pump 17A, on the basis of the upper limit value of suction torque selected by the first low-level selection unit 35 and the discharge pressure of the hydraulic pump 17A detected by the pump pressure sensors 25A, 25B.

The second flow rate calculation unit 37 calculates the second flow rate, which has to be discharged by the hydraulic pump 17A in accordance with the operation amount of the operation levers 22, 23, on the basis of detection signals of the operation pressure sensors 28*a* to 29*b*.

The second low-level selection unit 38 compares the first flow rate with the second flow rate to select the lower flow rate of the two, and outputs the selected flow rate to the regulator 24A.

Figure 5:
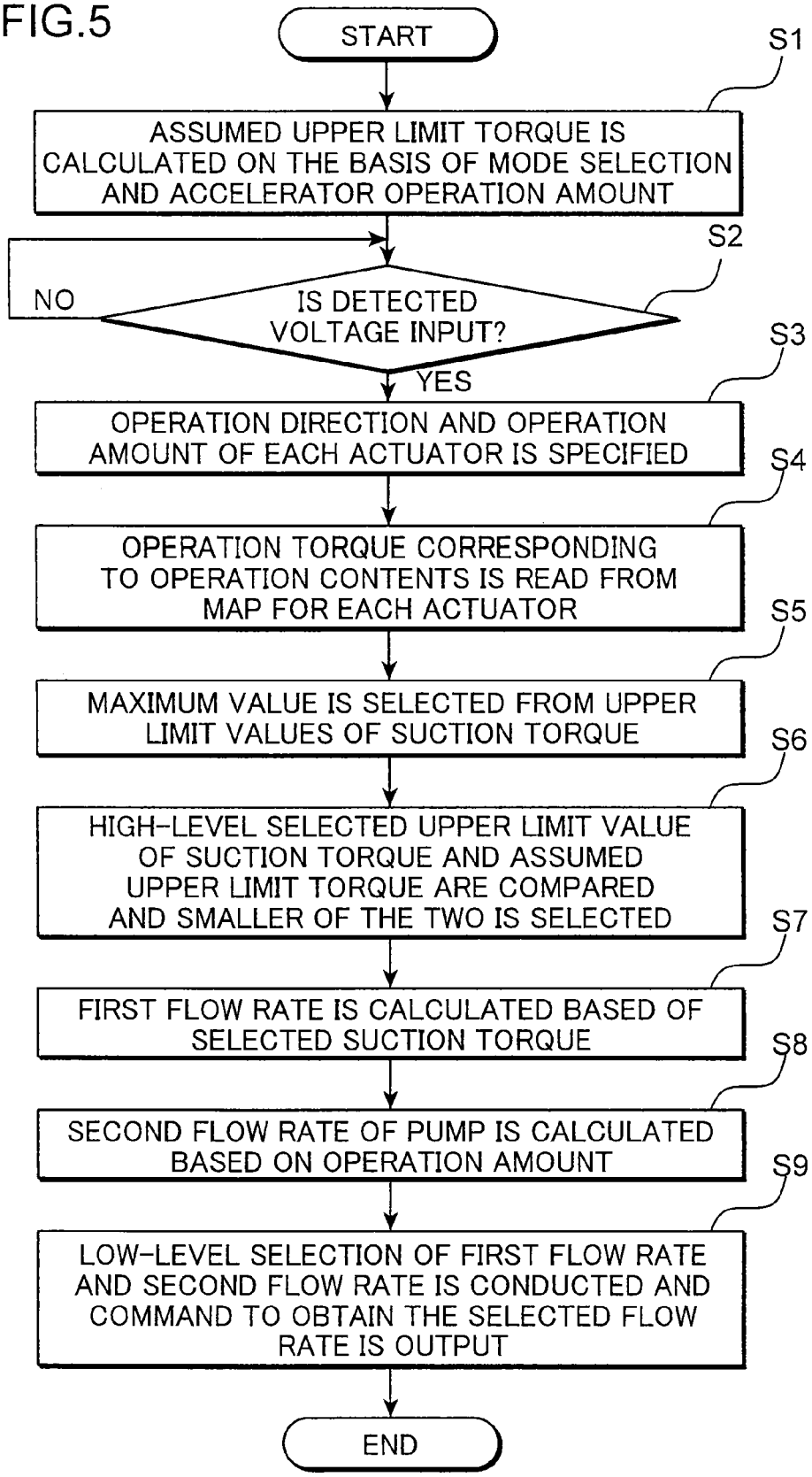
FIG. 5 is a flowchart executed by the control unit shown in FIG. 3.

The processing executed by the control unit 15 will be explained below with reference to FIG. 5.

The control unit 15 initially calculates the assumed upper limit torque, which is the upper limit value of suction torque of the hydraulic pump 17A for which the output of the engine does not exceed a predetermined value, on the basis of the input signal from the mode selection switch 39 or accelerator 40 (step S1).

Then, it is determined whether an operation pressure has been detected by at least one out of the operation pressure sensors 28*a* to 29*b* (step S2), and this step S2 is repeatedly executed till the operation pressure is detected.

Where the operation pressure is detected by the operation pressure sensors 28*a* to 29*b* (YES in step S2), the operation direction and operation amount are specified with respect to the cylinders 9, 11 (and all of the actuators to which the hydraulic oil is supplied from the hydraulic pump 17A) (step S3).

Then, the upper limit value of suction torque (ratio to the assumed upper limit torque) corresponding to the operation amounts of the operation levers 22, 23 are read (step S4) from the map (see FIG. 4) that has been set for each of all of the operation contents identified by the actuators and the direction of operations performed on the actuators, and the maximum value is selected from the upper limit values of suction torque (step S5).

More specifically, as shown in FIG. 4, when the operation amount of the boom lowering operation performed by the operation lever 22 is A2 and the operation amount of the bucket digging operation performed by the operation lever 23 is A1, the suction torque determined by the operation amount A2 of the operation lever 22 is selected. When the operation amount of the boom lowering operation performed by the operation lever 22 and the operation amount of the bucket digging operation performed by the operation lever 23 are both A1, the suction torque determined by the operation amount A1 of the operation lever 23 is selected.

With this step S5, the maximum suction torque out of the upper limit values of suction torque that is necessary in accordance with the operation amount of the operation levers 22, 23 is selected. Therefore, the operator's requirements can be satisfied and the necessary minimum limit suction torque can be selected.

Then, the high-level selected upper limit value of suction torque is compared with the assumed upper limit torque calculated in the step S1, the smaller of the two is selected (step S6), and the first flow rate is calculated based on the selected upper limit value of suction torque (step S7).

By so comparing the high-level selected one of the upper limit values of suction torque which is necessary by the actuators and the assumed upper limit torque and using the smaller of the two, it is possible to suppress the load on the engine 16 and prevent malfunctions such as engine stall, while the operation required by the user is realized at a maximum. In the present embodiment, in step S6, it is executed to compare the high-level selected upper limit value of suction torque and the assumed upper limit torque to select the smaller of the two, but this step S6 is not a mandatory processing step. In other words, the first flow rate may be also calculated on the basis of the upper limit value of suction torque that has been high-level selected by the high-level selection unit 33.

Further, the second flow rate, which is a discharge flow rate of the hydraulic pump 17A corresponding to the operation of the operation levers 22, 23 is calculated on the basis of detection results of the operation pressure sensors 28*a* to 29*b* (step S8), and a command is output to the regulators 24A, 24B such as to obtain the smaller flow rate out of the second flow rate and first flow rate (step S9).

As described hereinabove, with the present embodiment, the upper limit value of suction torque (torque ratio) of the hydraulic pump 17A is determined for each of operation contents of the cylinders 9, 11 and the hydraulic pump 17A is driven so as to obtain torque equal to or lower than the maximum suction torque out of the upper limit values of suction torque. Therefore, the setting of suction torque that exceeds the torque actually necessary for the operation of cylinders 9, 11 can be prevented.

Further, in the above-described embodiment, all of the maps stored in the storage unit 31 have a characteristic such that the upper limit value of suction torque varies in accordance with variations in the operation amount of the operation levers 22, 23. Therefore, the upper limit value of suction torque in a case of small operation value of the operation levers 22, 23 can be effectively suppressed.

In the above-described embodiment, the aforementioned map is set as a map having a characteristic such that in a range in which the operation amount of the operation levers 22, 23 is equal to or less than a constant amount, the upper limit value of suction torque is a constant value, regardless of the operation amount of the operation levers 22, 23, and in a range in which the operation amount exceeds the constant amount, the upper limit value of suction torque increases or decreases in accordance with the operation amount of the operation levers 22, 23. In other words, in the above-described embodiment, since the range below the constant amount from the non-operative state is considered as the so-called "play" of the operation levers 22, 23, even when the operator himself erroneously slightly operates the operation levers 22, 23 by contact or the like, the upper limit value of suction torque of the hydraulic pump 17A can be prevented from changing abruptly.

Further, in the above-described embodiment, where the operation amount of the operation levers 22, 23 exceeds the constant amount range, the upper limit value of suction torque increases or decreases correspondingly to the operation amount of the operation levers 22, 23. Therefore, the upper limit value of suction torque of the hydraulic pump 17A can be changed smoothly, by contrast with the case in which the upper limit of suction torque of the hydraulic pump 17A varies from the minimum value to the maximum value in response to the presence or absence of operation of the operation levers 22, 23.

Therefore, with the above-described embodiment, the feeling of discomfort experienced by the operator can be alleviated by reducing the width of variations in the upper limit value of suction torque in accordance with the operation amount of the operation levers 22, 23.

In the configuration according to the above-described embodiment, the upper limit value of suction torque selected by the high-level selection unit 33 is compared with the assumed upper limit torque and the smaller torque of the two is selected. With such a configuration, the hydraulic pump 17A is driven at all times by suction torque equal to or lower than the assumed upper limit torque, regardless of the upper limit value of torque selected by the high-level selection unit 33. Therefore, an excessive increase in the load of the engine 16 caused by a large upper limit value of suction torque selected by the high-level selection unit 33 can be avoided.

Further, in the above-described embodiment, the configuration is explained in which a map having a torque variation characteristic such that an upper limit value of suction torque varies in accordance with the operation amount of the operation levers 22, 23 is set with respect to all the operation contents of the actuators (see FIG. 4). Instead, out of the maps stored in the storage unit 31, the map relating to specific operation contents can be set such that the upper limit value of suction torque varies in accordance with the operation amount of the operation levers 22, 23 in the same manner as described above, whereas the maps relating to operations other than the specific operation can be set such that the upper limit value of suction torque is a constant value which is the assumed upper limit torque, regardless of the operation amount of the operation levers 22, 23. The processing conducted when such maps are used will be described below.

Figure 6:
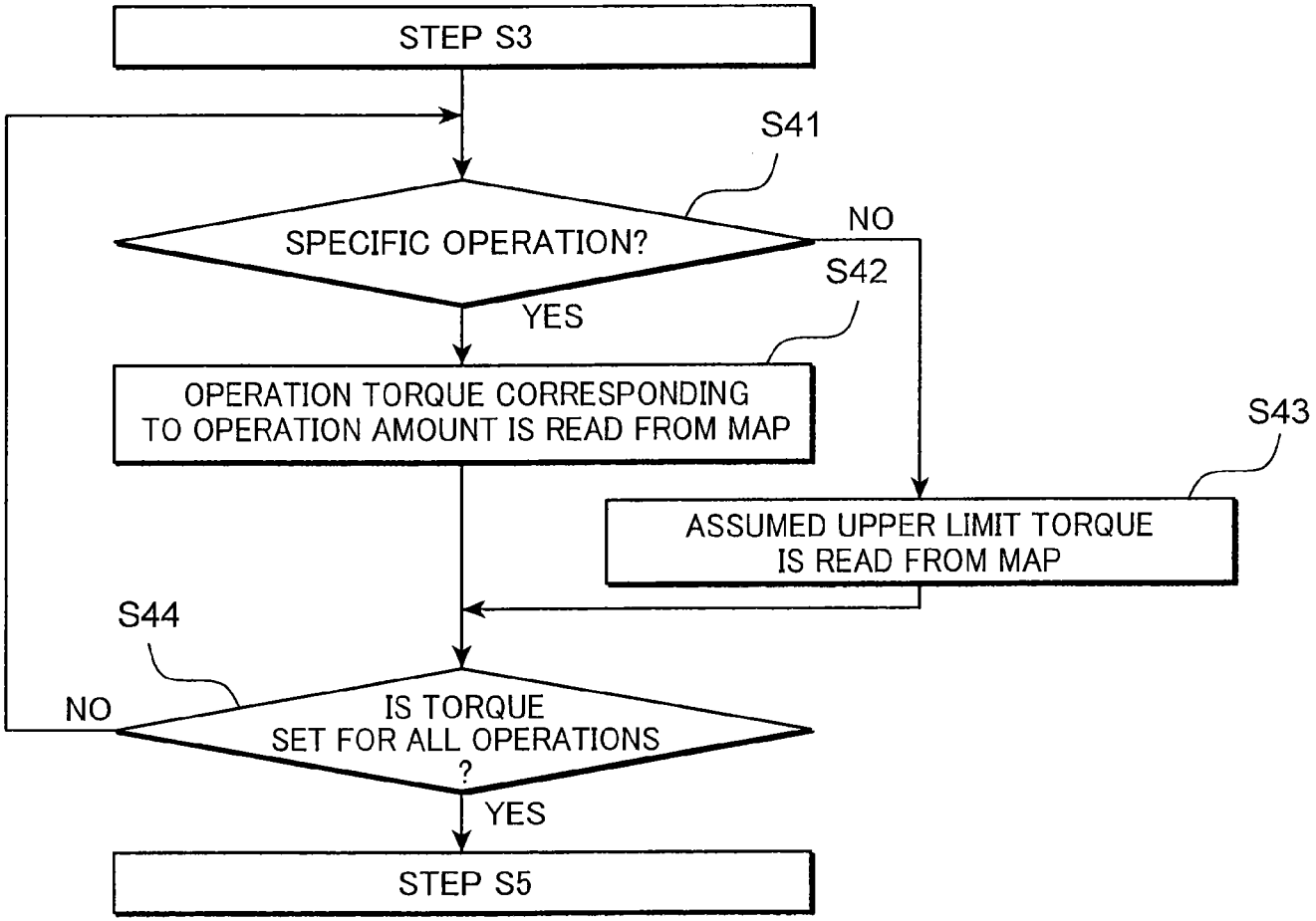
FIG. 6 is a flowchart illustrating the processing relating to another embodiment of the present invention.

FIG. 6 is a flowchart illustrating the processing relating to another embodiment of the present invention. FIG. 6 shows only those portions that are different from the flowchart in FIG. 5.

Referring to FIG. 6, where the operation direction and operation amount of each actuator are specified in step S3, it is determined whether the operation contents that are a setting object of the upper limit value of suction torque is specific operation contents that have been set in advance (step S41). In this case, an operation that is performed sufficiently by using a low suction torque (for example, boom lowering) is an example of the specific operation.

Where the operation is determined to be a specific operation in the determination process of step S41 (YES in step S41), an upper limit value of suction torque corresponding to the operation amount of the operation levers 22, 23 is read from the map stored in the storage unit 31 and set in the actuator (step S42). On the other hand, where the operation contents are determined not to be the specific operation contents (NO in step S41), the assumed upper limit torque is read from the storage unit 31 with respect to the actuator relating to the operation contents (step S43). In other words, in the present embodiment, the assumed upper limit torque that has been determined in the above-described step S1 (see FIG. 5) is stored in advance in the storage unit 31 and then read out therefrom in step S43.

By so reading the upper limit value of suction torque corresponding to the operation amount from the map with respect to a specific operation and reading the assumed upper limit torque from the map, which is constant regardless of the operation amount, with respect to the operation other than the specific operation, it is possible to prevent the setting of suction torque that exceeds the torque actually necessary for the operation that actually requires low suction torque.

Then, it is determined whether the torque has been set for all of the operations (step S44), and where it is determined that the remaining operations are present (NO in step S44), the aforementioned step S41 is repeatedly executed. On the other hand, where it is determined that the torque has been set for all of the operations (YES in step S44), the processing flow advances to step S5.

According to the above-described embodiment, the suction torque in a range with a small operation amount can be reduced by using a map that has a characteristic such that the upper limit value of suction torque varies in accordance with variations in operation amount of the input unit with respect to the specific operation contents out of the entire operation contents. And the occurrence of engine stall or the like can be inhibited, since the assumed upper limit torque is determined as the upper limit value of suction torque with respect to operation contents other than specific operation contents.

The aforementioned specific embodiment mainly includes the below-described features.

The present invention provides a controller for a work machine including a variable displacement hydraulic pump driven by an engine, a plurality of actuators to which hydraulic oil is supplied from the hydraulic pump, an input unit that receives an operation for inputting an actuation command relating to each of the actuators, a storage unit that stores torque information in which an operation amount and an upper limit value of suction torque of the hydraulic pump are associated with each other, for each operation content identified by an actuator that is selected to be operated from the actuators, and by a direction of the operation performed on this actuator, an operation torque determination unit that determines the upper limit value of suction torque for each actuator by using the torque information stored in the storage unit, when an actuation command relating to at least one actuator is input by the input unit, a high-level selection unit that selects the maximum upper limit value of suction torque out of the upper limit values of suction torque determined by the operation torque determination unit, and a displacement regulation unit that regulates a displacement of the hydraulic pump so as to obtain torque equal to or lower than the suction torque selected by the high-level selection unit, wherein the torque information relating to at least one operation content, out of the torque information stored in the storage unit, has a characteristic such that the upper limit value of suction torque varies in accordance with variations in operation amount of the input unit.

In accordance with the present invention, the upper limit value of suction torque of the hydraulic pump is determined for each operation content of actuators and the hydraulic pump is driven so as to obtain torque equal to or less than the maximum suction torque out of these upper limit values of suction torque. Therefore, the setting of suction torque that exceeds the torque actually necessary for each actuator can be prevented.

In accordance with the present invention, there is at least one torque information having a characteristic such that the upper limit value of suction torque varies in accordance with variations in operation amount of the input unit. Therefore, with respect to the actuator relating to this torque information, the upper limit value of suction torque can be set to a smaller value when the operation amount of the input unit is small than in the case in which the upper limit value of suction torque is constant regardless of operation amount of the input unit.

In particular, where the controller for a work machine is configured such that all of the torque information stored in the storage unit has a torque variation characteristic such that the upper limit value of suction torque varies in accordance with variations in operation amount of the input unit, the upper limit value of suction torque in the case of a small operation amount can be greatly reduced.

In the controller for a work machine, it is preferred that the torque variation characteristic include a characteristic such that the upper limit value of suction torque is a constant value regardless of the operation amount of the input unit when the operation amount of the input unit is equal to or less than a constant amount, while the upper limit value of suction torque increases or decreases in accordance with the operation amount of the input unit when the operation amount exceeds the constant amount.

With such a configuration, the range below the constant amount from the non-operative state is considered as the so-called "play" of the input unit. Therefore, even when the operator himself erroneously slightly operates the input unit by contact or the like, the upper limit value of suction torque of the hydraulic pump can be prevented from changing abruptly.

Further, in the above-described configuration, where the operation amount exceeds the constant amount range, the upper limit value of suction torque increases or decreases correspondingly to the operation amount of the input unit. Therefore, the upper limit value of suction torque of the hydraulic pump can be changed smoothly, by contrast with the case in which the upper limit of suction torque of the hydraulic pump varies from the minimum value to the maximum value in response to the presence or absence of operation of the input unit.

Therefore, with the above-described configuration, the feeling of discomfort experienced by the operator can be alleviated by reducing the width of variations in the upper limit value of suction torque in accordance with the operation amount of the input unit.

The controller for a work machine preferably further includes a low-level selection unit that compares an assumed upper limit torque that is set as an upper limit value of suction torque of the hydraulic pump at which an output of the engine does not exceed a predetermined value with the upper limit value of suction torque selected by the high-level selection unit to select the smaller torque of the two, wherein the displacement regulation unit regulates the displacement of the hydraulic pump so as to obtain a value equal to or lower than the upper limit value of suction torque selected by the low-level selection unit.

With such a configuration, the hydraulic pump is driven at all times by suction torque equal to or lower than the assumed upper limit torque, regardless of the upper limit value of torque selected by the high-level selection unit. Therefore, an excessive increase in the engine load caused by a large upper limit value of suction torque selected by the high-level selection unit can be avoided.

In the controller for a work machine, the storage device preferably stores torque information having a characteristic such that an upper limit value of suction torque varies in accordance with variations in operation amount of the input unit with respect to specific operation contents that are some of the operation contents, and stores torque information having a characteristic such that an upper limit value of suction torque is a constant value which is an assumed upper limit torque that is set as an upper limit value of the hydraulic pump at which an output of the engine does not exceed a predetermined value, regardless of the operation amount, with respect to operation contents other than the specific operation contents.

With such a configuration, suction torque in a range with a small operation amount can be reduced by using torque information having a characteristic such that an upper limit value of suction torque varies in accordance with variations in operation amount of the input unit with respect to specific operation contents, and the occurrence of engine stall or the like can be inhibited by setting the assumed upper limit torque as the upper limit value of suction torque with respect to operation contents other than the specific operation contents. In this case, "the specific operation contents" are preferably operation contents with a comparatively small load. For example, a boom lowering operation can be specific operation contents.

In the controller for a work machine, the operation torque determination unit preferably determines the upper limit value of suction torque as a ratio to the assumed upper limit torque.

With such a configuration, suction torque of the hydraulic pump can be determined as a relative value with respect to the assumed upper limit torque.

The present invention provides a work machine including an engine, and the controller, wherein the input unit of the controller receives an operation for inputting an actuation command relating to each of the actuators, the operation torque determination unit determines an upper limit value of suction torque of the hydraulic pump for each of the actuators, and the displacement regulation unit regulates a displacement of the hydraulic pump so as to obtain torque equal to or lower than the maximum upper limit value of suction torque out of the upper limit values of suction torque.

This application is based on Japanese patent application serial no. 2009-130071, filed in Japan Patent Office on May 29, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A controller for a work machine, comprising:

a variable displacement hydraulic pump driven by an engine;

a plurality of actuators to which hydraulic oil is supplied from the hydraulic pump;

an input unit outputting an actuation command relating to each of the actuators when the input unit receives an operation from an operator;

a storage unit in which torque information is stored, wherein the torque information, includes, for each actuator, a set of suction torque values and actuation commands associated with each other, for all possible actuation commands; wherein at least one set of torque values and actuation commands has torque values which varies with variation in actuator command;

an operation torque determination unit that determines the suction torque value for each actuator by using the torque information stored in the storage unit, when an actuation command relating to at least one actuator is input by the input unit;

a high-level selection unit that selects a suction torque as being a maximum of the suction torque values determined by the operation torque determination unit; and a displacement regulation unit that regulates a displacement of the hydraulic pump so as to obtain torque equal to or lower than the suction torque selected by the high-level selection unit.

2. The controller for the work machine of claim 1, wherein every set of torque values and actuation commands has torque values which varies with variation in actuator command.

3. The controller for the work machine of claim 2, wherein a set of torque values and actuation commands has torque values being constant when the actuation command is less than or equal to a first value and varies with the actuator command when greater than the first value.

4. The controller for a work machine according to claim 1, further comprising:

a low-level selection unit that compares an assumed suction torque of the hydraulic pump at which an output of the engine does not exceed a predetermined value with the suction torque selected by the high-level selection unit to select the smaller torque of the two, wherein the displacement regulation unit regulates the displacement of the hydraulic pump so as to obtain a value equal to or lower than the suction torque selected by the low-level selection unit.

5. The controller for the work machine of claim 1, wherein a set of torque values and actuation commands has torque values being a constant value regardless of the actuation command, wherein the constant value is an assumed torque of the hydraulic pump at which an output of the engine does not exceed a predetermined value.

6. The controller for a work machine according to claim 4, wherein the suction torque as a ratio to the assumed suction torque in the storage unit is stored.

* * * * *

UNITED STATES PATENT AND TRADEMARK OFFICE

CERTIFICATE OF CORRECTION

PATENT NO. : 8,726,649 B2
APPLICATION NO. : 12/787706
DATED : May 20, 2014
INVENTOR(S) : Takao Nanjo et al.

It is certified that error appears in the above-identified patent and that said Letters Patent is hereby corrected as shown below:

On the title page, Item (73), the Assignees' Information is incorrect. Item (73) should read:

--(73) Assignees: Kabushiki Kaisha Kobe Seiko Sho (Kobe Steel, Ltd.), Kobe-shi (JP); Kobelco Construction Machinery Co., Ltd., Hirohima-shi (JP)--

Signed and Sealed this
Seventh Day of October, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,726,649 B2
APPLICATION NO. : 12/787706
DATED : May 20, 2014
INVENTOR(S) : Takao Nanjo et al.

It is certified that error appears in the above-identified patent and that said Letters Patent is hereby corrected as shown below:

On the title page, Item (73), the Assignees' Information is incorrect. Item (73) should read:

--(73) Assignees: Kabushiki Kaisha Kobe Seiko Sho (Kobe Steel, Ltd.), Kobe-shi (JP); Kobelco Construction Machinery Co., Ltd., Hiroshima-shi (JP)--

This certificate supersedes the Certificate of Correction issued October 7, 2014.

Signed and Sealed this
Twenty-seventh Day of January, 2015

Michelle K. Lee

Michelle K. Lee
*Deputy Director of the United States Patent and Trademark Office*